US006607123B1

(12) United States Patent
Jollifee et al.

(10) Patent No.: US 6,607,123 B1
(45) Date of Patent: Aug. 19, 2003

(54) IDENTIFYING GOLF BALLS

(75) Inventors: Steven Paul Jollifee, Northwood (GB); David Victor Jollifee, Northwood (GB); Geoffrey Emerson, Northwood (GB)

(73) Assignee: S World Golf Systems Ltd., Eastcote Middlesex (GB)

( * ) Notice: Subject to any disclaimer, the term of this patent is extended or adjusted under 35 U.S.C. 154(b) by 0 days.

(21) Appl. No.: 09/646,470

(22) PCT Filed: Mar. 19, 1999

(86) PCT No.: PCT/GB99/00883

§ 371 (c)(1),
(2), (4) Date: Nov. 9, 2000

(87) PCT Pub. No.: WO99/48046

PCT Pub. Date: Sep. 23, 1999

(30) Foreign Application Priority Data

Mar. 19, 1998 (GB) ..... 9805911

(51) Int. Cl.[7] ..... G06F 17/00
(52) U.S. Cl. ..... 235/375; 273/182 A
(58) Field of Search ..... 235/462.01, 472.01, 235/375, 381, 383; 273/182, 35 R, 14, 34 R, 62, 177 R, 213, 398, 389, 394, 113, 125

(56) References Cited

U.S. PATENT DOCUMENTS

| | | | | |
|---|---|---|---|---|
| 4,516,770 A | | 5/1985 | Brookes et al. | |
| 5,370,389 A | * | 12/1994 | Reising | 473/153 |
| 5,439,224 A | | 8/1995 | Bertoncino | |
| 5,445,374 A | * | 8/1995 | Clark, Jr. | 473/153 |
| 5,487,542 A | | 1/1996 | Foley | |
| 5,505,452 A | * | 4/1996 | Meaden | 273/182 |
| 5,626,531 A | | 5/1997 | Little | |
| 5,632,687 A | * | 5/1997 | Bunyi | 221/265 |
| 5,653,642 A | | 8/1997 | Bonacorsi | |
| 5,743,804 A | * | 4/1998 | Bacon | 473/132 |
| 5,743,815 A | | 4/1998 | Helderman | |
| 5,916,033 A | * | 6/1999 | Doherty | 473/135 |
| 6,322,455 B1 | * | 11/2001 | Howey | 273/461 |
| 6,338,685 B1 | * | 1/2002 | Posluszny | 473/386 |
| 6,348,017 B1 | * | 2/2002 | Yates | 294/19.2 |

FOREIGN PATENT DOCUMENTS

| | | | |
|---|---|---|---|
| GB | 2267222 A | | 1/1993 |
| WO | WO93/25286 | * | 12/1993 |
| WO | WO 99/48046 | * | 9/1999 |
| WO | WO 01/49379 A2 | * | 7/2001 |
| WO | WO 02/40111 A 1 | * | 5/2002 |

* cited by examiner

*Primary Examiner*—Thien M. Le
(74) *Attorney, Agent, or Firm*—Sheridan Ross PC

(57) ABSTRACT

In a golf driving range (10, FIG. 1 not shown) golf balls (21) incorporating uniquely-coded passive transponders are collected by means of a device having a receiving channel (22) which directs the balls past a reader (25) employing RFID technology which reads the codes and supplies this information via a link (32) to a central computer for subsequent display. The reader (25) also actuates a gate (28) to direct the balls to a "reject" receptacle (29) or an "accept" receptacle (30). Similar devices are used for dispensing golf balls (50, FIG. 4 not shown) or supplying balls to an automatic tee device (70, FIG. 5 not shown). Alternatively balls can be identified on or near a tee (84, FIGS. 6 and 7 not shown) on a mat (70).

8 Claims, 4 Drawing Sheets

IDENTIFYING GOLF BALLS

The present invention relates to the identification of articles, especially golf balls, which are marked, distributed from a base and subsequently collected.

Golf driving ranges are becoming increasingly popular, especially those involving scoring and other competitions. In such cases the ability to identify a collected ball is important Even in conventional driving ranges, the ability to identify golf bell can facilitate charging players and or detecting theft.

U.S. Pat. No. 5,439,224 discloses a golf range with targets provided with optical scanners to identify balls and to pass the information to a programmed computer. U.S. Pat. No. 5,370,389 discloses a golfing range game in which a ball rolling into a hole is sensed by a scanner which identifies the tee from which the ball was driven by detecting the colour of the ball or a bar code printed thereon; the information is passed back to a display near the golfer. U.S. Pat. No. 5,653,642 discloses a driving range with targets with optical readers for detecting unique identification ball codes, the optical readers being connected to a computer device.

Systems employing optical codes have a number of disadvantages. In particular, dirt on the ball can prevent correct identification. Also, the optical codes are subject to wear and abrasion. Furthermore, the orientation of the ball relative to the optical reader is important in order for the code to be correctly read. In addition the coding markings can be visually intrusive.

GB-A-2267222 discloses a golf driving range employing balls which are distinguished from each other by means of bar codes or transponders. Ball detecting means are provided at the holes and the surrounding greens. The disclosure of this document corresponds to the introductory part of claim 1.

U.S. Pat. No. 5,626,531 discloses golf balls with passive tags which can be sensed by an electronic detection system and U.S. Pat. No. 5,743,815 discloses a golf ball housing a passive transponder which may be uniquely coded.

U.S. Pat. No. 4,516,770 discloses a ball detection and identification arrangement for a table ball game, e.g. pool. Balls landing in the pockets pass to an electronic detector which operates a display and scoring device.

U.S. Pat. No. 5,487,542 discloses a golf game with identifiable golf clubs and means for sensing the presence of a golf ball in a hole. In a modification the balls may be uniquely coded optically.

The present invention seeks to overcome or reduce the above disadvantages.

According to a first aspect of the present invention there is provided a golf driving range employing uniquely-coded golf balls characterised in that a tee of the range incorporates ball-identifying means connected to a computer system so that the computer system knows which ball a player is driving from said tee.

According to a second aspect of the present invention there is provided a golf driving range comprising means for supplying golf balls to a player, said supply means incorporating first ball-identifying means, the range further comprising means for collecting driven balls incorporating second ball-identifying means, the range further comprising means for processing the output of said first and second ball-identifying means, wherein each golf ball incorporates a coded RF-transponder and the first and second ball-identifying means employ RFID technology.

According to a third aspect of the present invention, there is provided a golf driving range comprising means for supplying golf balls one-by-one to a player, said supply means incorporating first ball-identifying means, the range further comprising means for collecting balls driven by the player, said collecting means incorporating second-ball identifying means, the range further comprising means for processing the output of said first and second ball-identifying means, each golf ball incorporating a RF-transponder having a unique code, and the first and second ball-identifying means employing RFID technology, wherein the golf balls to be supplied to the player are fed one-by-one from a holder of a plurality of golf balls past the first ball-identifying means and are then supplied in the same order to the player.

The outputs of said first and second ball-identifying means are preferably supplied to a computer, which processes the received information and provides a display of the result.

The supplying and collecting means preferably comprise channels for directing golf balls, and the first and second ball-identifying means are preferably RFID readers with reading heads located directly adjacent the respective channels.

The balls collected by the collecting means may be arranged to be supplied to the supplying means for recycling.

According to a fourth aspect of the present invention there is provided an apparatus for supplying golf balls one-by-one to a player and incorporating ball-identifying means and means for processing the output of said ball-identifying means, each golf ball incorporating a RF-transponder having a unique code and the ball-identifying means employing RFID technology wherein the golf balls to be supplied to the player are fed one-by-one from a holder of a plurality of golf balls past the ball-identifying means and are then supplied in the same order to the player.

Preferred embodiments of the present invention will now be described, by way of example only, with reference to the accompanying drawings.

Figure 1:
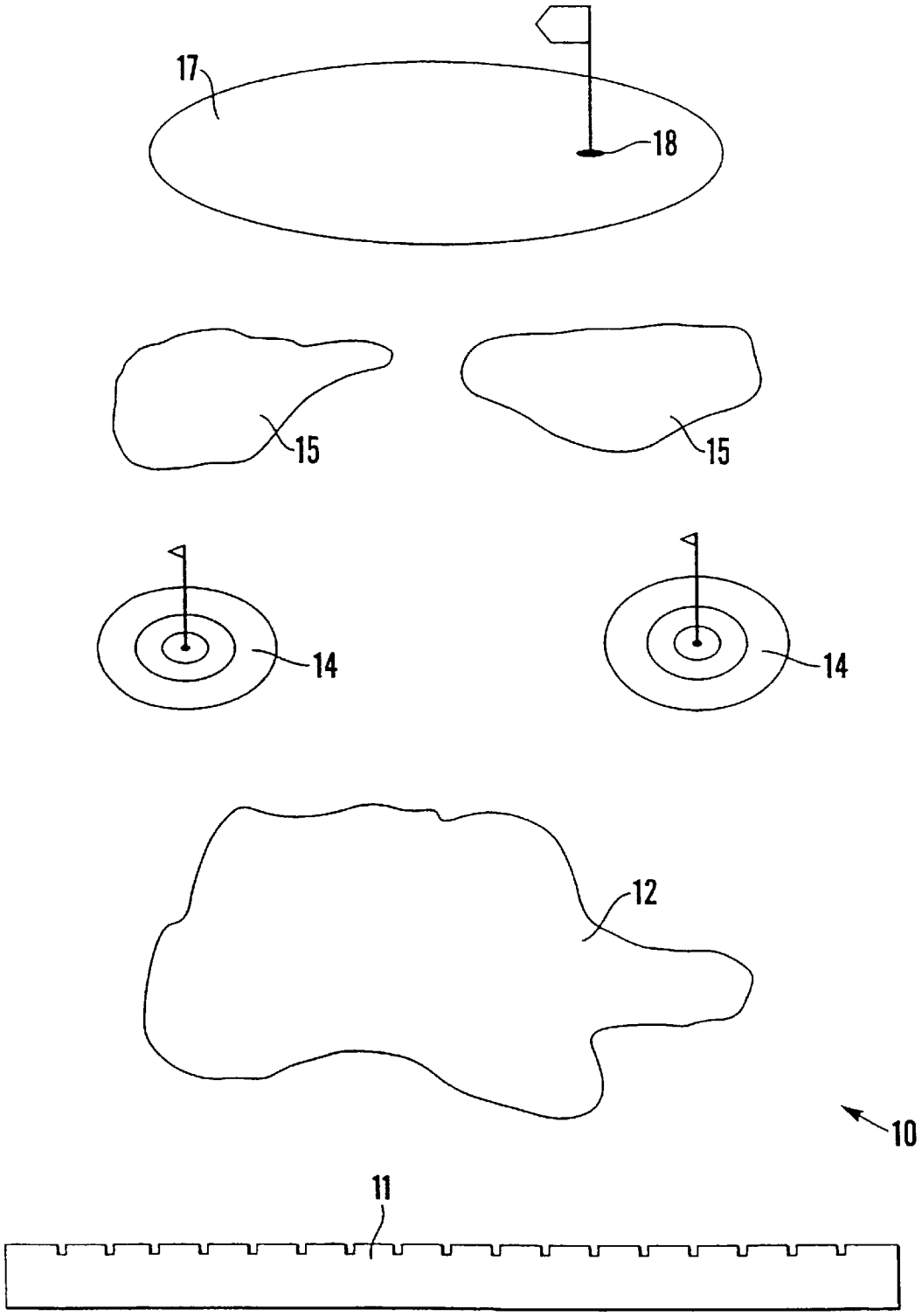
FIG. 1 is a schematic plan view of a golf driving range.

Referring to the drawings, FIG. 1 shows a golf driving range 10 comprising golf ball hitting bays 11, a water hazard 12, golf targets 14, bunkers 15 and a golf green 17 having a hole 18.

Figure 2:
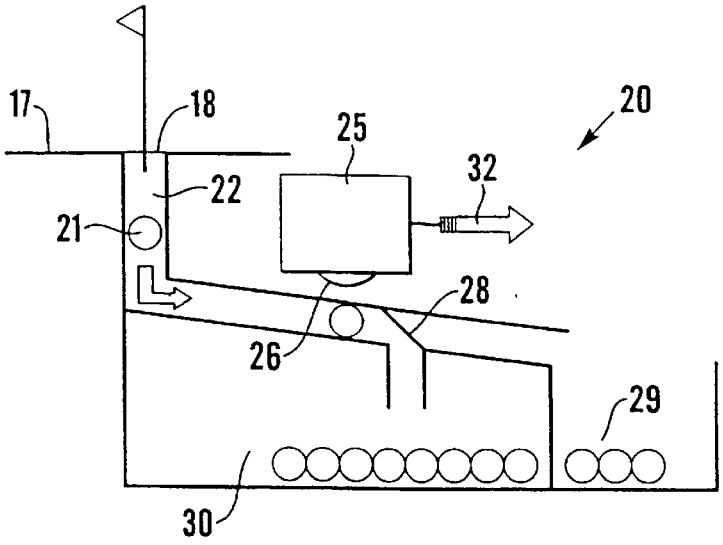
FIG. 2 is a schematic side view of a golf ball collection and identification device associated with a hole or target of the range of FIG. 1.

For use on the range 10, there are provided uniquely-coded golf balls. In contrast to the above-mentioned known devices, the balls each carry a passive transponder tag employing radio frequency identification (RFID) technology. The tag or chip may be placed in the ball during manufacture. Alternatively a small hole is drilled in the ball, a tag is inserted, and the hole filled up with a flexible sealant. In practice, RFID tags have been found to be robust enough to withstand the impacts experienced by a golf ball, and the presence of the tag has not affected the driving characteristics of the ball. FIG. 2 shows a collection and identification device 20 which is associated with hole 18. A golf ball 21 falling into the hole passes down a channel 22 past an RFID ball reader 25. Because the path of ball 21 is carefully controlled it can pass very close to the reading head 26 ensuring accurate interrogation of the code of the tag inside the ball.

If a valid code is not detected, reader 25 operates a control gate 28 to direct the ball to a receptacle 29 for rejected balls. If a valid code is detected, gate 28 allows the ball to pass to an appropriate receptacle 30, from which they are returned periodically or continuously, and manually or automatically to a golf ball dispensing arrangement, see FIGS. 3 and 4. At the same time as controlling gate 28, the valid code is supplied via a connection link 32 to a computer incorporating a memory which stores data regarding the golfer who was issued with the ball. This information may be exploited in various ways as disclosed below.

Each hole 18 on the driving range and each relevant area of a target 14 is provided with a respective reader 25. Where the area is substantial, it may slope towards a collecting funnel or chamber to direct balls towards the reader. Thus the data supplied to the computer also includes information as to which of the readers 25 detected and identified the ball.

Figure 3:
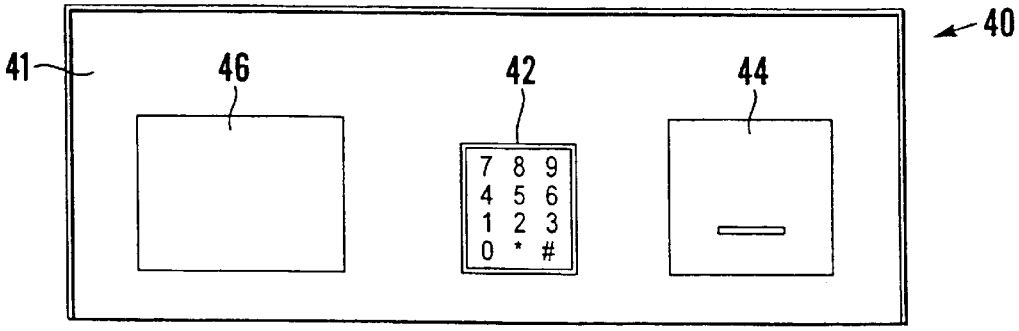
FIG. 3 is a schematic view of a golf ball dispenser.

FIG. 3 shows a control and display panel 41 of a golf ball dispenser 40 which is arranged to be located adjacent the driving bays 11. The dispenser may be operated by the golfers themselves or by an operator and comprises a keyboard 42 and a smart card reader 44, one or both of which may be used to enter information enabling a particular golfer to be identified. The dispenser also comprises a V.D.U. screen 46 to display information to the golfer such as the current content of a golfer's smart card (e.g. the amount of money remaining) and/or the number of balls issued. During actual driving, a separate screen located in a bay, or in a group of bays, displays information regarding the successful outcome, or otherwise, of a golf drive into the range 10. The result of satisfactory operation (including any necessary payment) of dispenser 40 causes the issue of a basket 48, FIG. 4, or other container, of golf balls 21 to a golfer.

Figure 4:
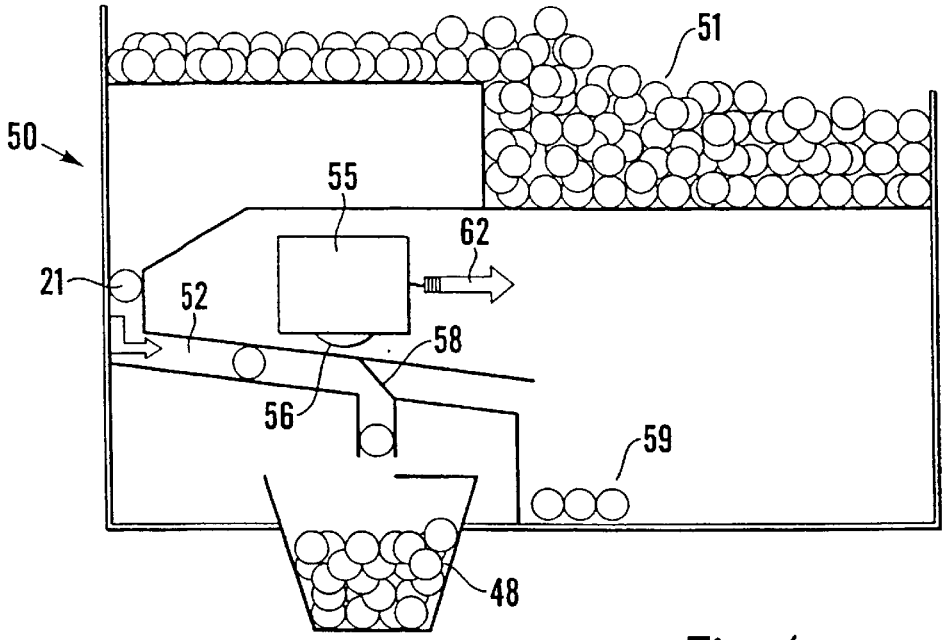
FIG. 4 is a schematic side view of a golf ball collection and identification device associated with the golf ball dispenser of FIG. 3.

FIG. 4 shows a golf ball identification and issuing device 50 for the supply of balls to the container 48, Fresh balls, or balls recovered from previous use via receptacle 30, are collected in a storage area 51. They are fed via a channel 52 past an RFID ball reader 55 with a reading head 56. Just as with reader 25 of device 20, reader 55 has an associated gate 58 for supplying received golf balls to a reject bin 59 or to basket 48. Reader 55 is connected via link 62 to the computer, and the memory stores data regarding which golfer was issued with which balls.

The system as described so far, generally enables golf balls used on a driving range to be allocated and tracked to provide feedback to players. In particular, it makes it possible to:

Set-up a premium driving range whereby top quality balls can be hired to golfers with significantly reduced likelihood of theft. Named members only would be able to play and each ball allocated to them would be recorded by the computer. If the ball went missing, suspicion would fall on the person last allocated the ball. In addition, there could be detected where customers leave the range, as in some clothing stores. Install custom designed targets that provide instantaneous (or delayed) feedback to players. This enables games, competitions and leagues as well as helping golfers practice and improve.

Award prizes for holes-in-one, longest drive, highest score etc.

Develop a game specifically targeted at golfers wishing to gamble (A "casino" range). Each individually and uniquely tagged ball effectively becomes a chip of known value. This values can vary according to the stakes the player wishes to gamble. The winnings will depend on the success of the shots and this will depend on a combination of skill and luck. As above, custom-designed targets that provide instantaneous (or delayed) feedback to players may be installed.

Develop a chipping and/or putting game. This could be designed for indoors along lines that are a cross between a driving range and a 10-pin bowling alley. i.e. each player would play from the same post by hitting towards different greens (say 10 of them). Scoring would be automatic and depend on exactly where the ball ended up. This game could, of course, also be developed for outdoors where the climate allows.

Figure 5:
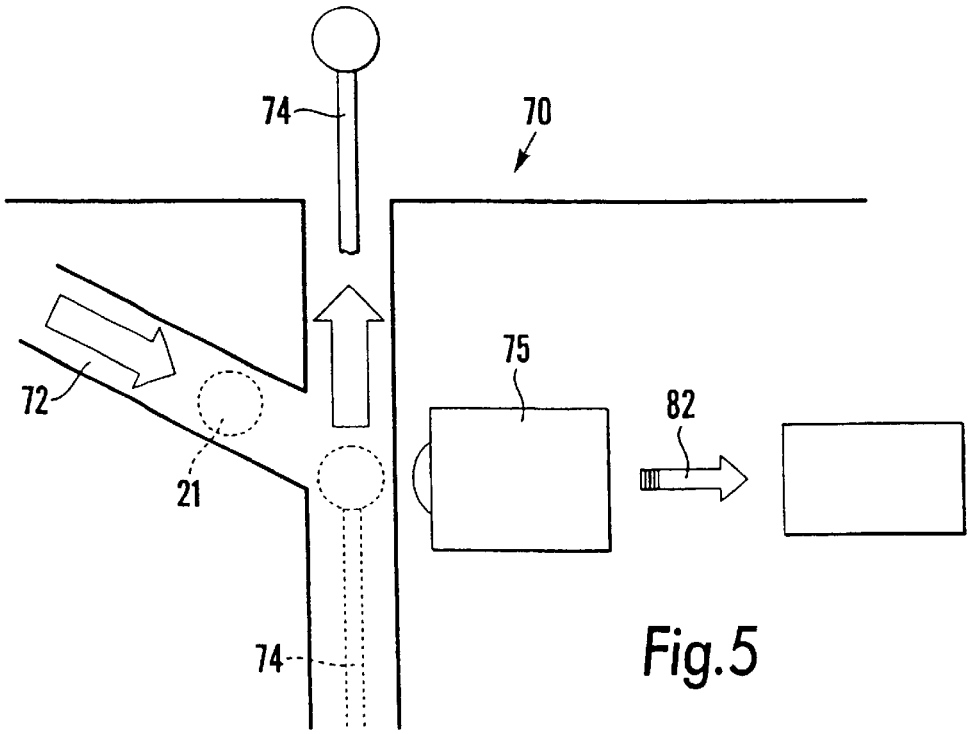
FIG. 5 is a schematic side view of an automatic tee device for use in accordance with a first embodiment of the present invention as an alternative to the device of FIG. 4; and FIGS., 6 and 7 are top and side views respectively of a mat-based identification system for use in ranges according to a second embodiment the present invention.

Automatically dispensing and allocating a desired number of known balls to known players can be carried out using existing technology but combined with the RFID readers 25,55 and appropriate computer programs. In a first embodiment of the present invention, balls are issued one-by-one to a golfer by means of the automatic tee device 70 of FIG. 5, instead of the dispenser of FIG. 4. Balls 21 enter via a channel 72 to a position where it sits on the top of a push rod 74. Here it is read by an RFID reader 75 which is similar to readers 25,55 and which supplies the unique code of the ball by means of a link 82 to the computer. The computer then matches the ball to the player at that tee. Push rod 74 is then moved upwardly to make the ball available for driving. Thus the computer system knows the particular ball which the player is driving.

Figure 6:
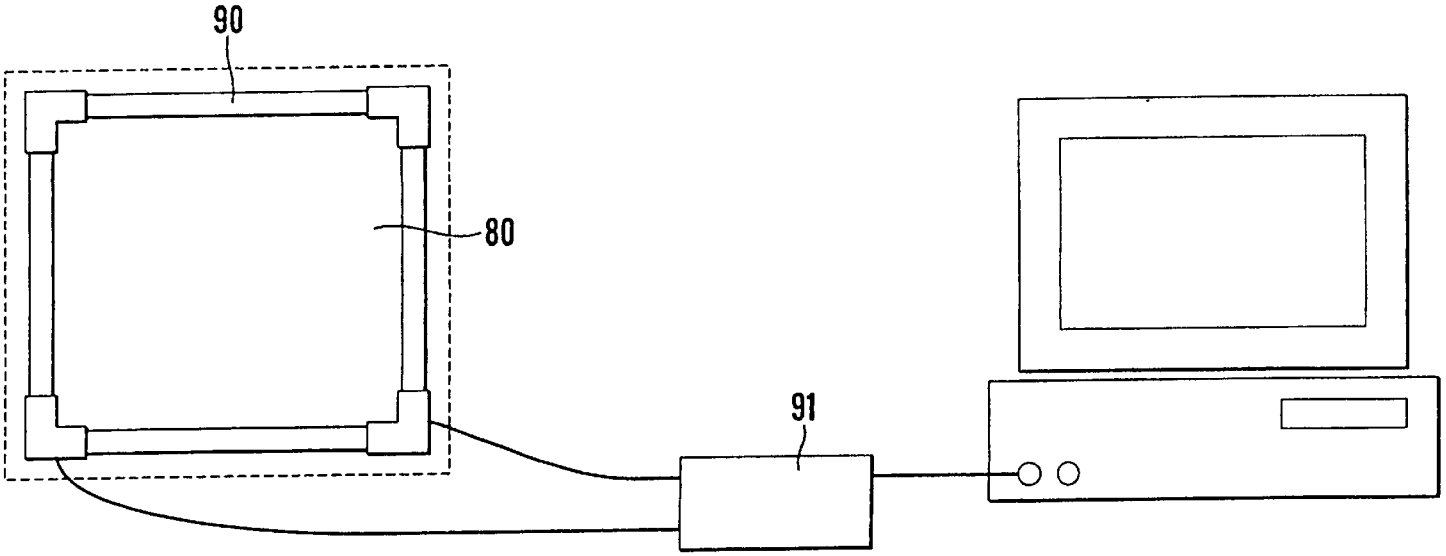
Figure 7:
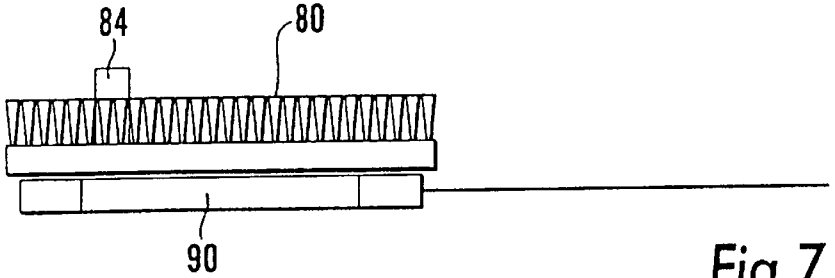

In another modification, the despenser of FIG. 4, or a similar dispenser, is followed by a "smart mat" arrangement in accordance with a second embodiment of the present invention as shown in FIGS. 6 and 7. As a golfer places one of his or her golf balls on or adjacent the tee 84 on a mat 80, the ball's identification code is detected by an antenna 90 embedded in or underneath the mat, and a decoder 91 connected to the computer.

In one example, using an artificial grass sample a relevant sized antenna is constructed to be fitted underneath. The antenna is constructed from 25 mm water pipe with conduit connections to allow cable access.

Thus type of construction is durable, weatherproof, relatively low cost, simple to maintain and install, and the antenna size can be varied for larger or smaller tee areas. The antenna can also be used for permanent installation on grass tees requiring only one cable connection to operate. Due to its portability, provided that the necessary power connections are available, the mat 80 can be moved to various teeing points as required. A battery powered mat system could be an option giving total flexibility in location. The balls can be decoded in any position on the mat and on the raised tee position.

The associated computer software displays information showing when a ball is present on the mat 80, the ball count and player name.

The mat system recognises when a ball is present and increments the ball count. It only allows each ball to be counted once even if the player removes the ball from the mat and replaces it.

What is claimed is:

1. A golf driving range employing uniquely-coded golf balls wherein a tee of the range incorporates ball-identifying means connected to a computer system so that the computer system knows which ball a player is driving from said tee, the range further comprising means which automatically supply balls one-by-one to said tee, said supply means comprising means for moving each successive ball from a first position in which it can be identified by said ball-identifying means to a second position in which it can be driven from said tee by a player, and wherein the ball-identifying means is arranged in or underneath said tee so that it can identify a ball placed thereon or adjacent thereto.

2. A range according to claim 1, wherein said supply means comprises a channel for supplying each successive ball to said first position, in which it rests on a push rod, the push rod being movable to place the ball in said second position.

3. A range according to claim 1, further comprising means for collecting driven balls and incorporating second ball-identifying means also connected to said computer system.

4. A range according to claim 1, wherein each golf ball incorporates a coded RF-transponder and the ball-identifying means employ RFID technology.

5. A golf driving range employing uniquely-coded golf balls, comprising:

(a) a computer system;

(b) a tee;

(c) a ball-identifying device operable to identify a golf ball and connected to the computer system, whereby the computer system knows which golf ball a player is driving from said tee, wherein the ball-identifying device is located at the tee; and (d) a ball supplying device operable to supply automatically golf balls one-by-one to the tee, the supplying device comprising a ball displacement device operable to displace each successive ball from a first position in which the ball can be identified by the ball-identifying device to a second position in which the ball can be driven from the tee by a player, wherein the ball-identifying device is arranged in or underneath the tee so that the ball-identifying device can identify a ball placed on the tee or adjacent to the tee.

6. A range according to claim 5, wherein the supplying device comprises a channel operable to supply each successive ball to the first position, in which the ball rests on a push rod, the push rod being movable to place the ball in said second position.

7. A range according to claim 5, further comprising a device operable to collect driven balls and incorporating a second ball-identifying device also connected to said computer system.

8. A range according to claim 5, wherein each golf ball incorporates a coded RF-transponder and the ball-identifying device employs RFID technology.

* * * * *

UNITED STATES PATENT AND TRADEMARK OFFICE

CERTIFICATE OF CORRECTION

PATENT NO. : 6,607,123 B1
DATED : August 19, 2003
INVENTOR(S) : Steven Paul Jolliffe It is certified that error appears in the above-identified patent and that said Letters Patent is hereby corrected as shown below:

Title page,
Item [73], Assignee, should read:
-- [73] Assignee: World Golf Systems Ltd., Eastcote
Middlesex (GB) --

Signed and Sealed this

Thirtieth Day of December, 2003

JAMES E. ROGAN
*Director of the United States Patent and Trademark Office*